US006079242A

United States Patent [19]

Allegro et al.

[11] Patent Number: 6,079,242

[45] Date of Patent: Jun. 27, 2000

[54] CONTROL PROCESS FOR CONTINUOUS SKIN PASS OPERATION FOR METAL STRIP

[75] Inventors: Fernand Allegro, Ruminghem; Frédéric Bertolini, Ghyvelde; Rodolphe Devos, Le Frinckoucke; Régis Mieze, Grand Fort Philippe; Philippe Reynoudt, Bierne; Bruno Sparty, Teteghem; Michel Chauvire, Coueron; Gilles Revoir, Sauteron; Didier Becler, Lantefontaine; Christophe Silvy-Leligois, Metz, all of France

[73] Assignee: Sollac, Puteaux, France

[21] Appl. No.: 09/229,565

[22] Filed: Jan. 13, 1999

[30] Foreign Application Priority Data

Jan. 13, 1998 [FR] France ..... 98 00214

[51] Int. Cl.[7] ..... B21B 37/48

[52] U.S. Cl. ..... 72/8.6; 72/10.3; 72/11.4; 72/205; 72/365.2

[58] Field of Search ..... 72/8.3, 8.4, 8.6, 72/10.3, 11.4, 12.3, 205, 365.2

[56] References Cited

U.S. PATENT DOCUMENTS

| | | | |
|---|---|---|---|
| Re. 30,933 | 5/1982 | Toda et al. | 72/202 |
| 3,820,365 | 6/1974 | Silva . | |
| 4,016,740 | 4/1977 | Gondo et al. | 72/128 |
| 4,188,812 | 2/1980 | Nomura et al. | 72/203 |
| 4,760,723 | 8/1988 | Nakagawa | 72/8.6 |
| 5,054,302 | 10/1991 | Yamashita et al. | 72/8.4 |

FOREIGN PATENT DOCUMENTS 2 584 631 1/1987 France .

OTHER PUBLICATIONS

Patent Abstracts of Japan, vol. 012, No. 157 (M–696), May 13, 1988 & JP 62 275514 A (Sumitomo Metal Ind Ltd), Nov. 30, 1987.

Aeberli K: "New Aluminium Cold Rolling Mill in Japan Produces Top–Quality Can Sheet" Engineering and Automation, vol. 16, No. 6, Nov. 1, 1994, pp. 20–23, XP000506348.

Yuji Shimoyama et al: "Kawasaki Steel Continuous Annealing Line at Chiba" Iron and Steel Engineer, vol. 69, No. 11, Nov. 1, 1992, pp. 35–41, XP000336359.

Silvy–Leligois C: "Regulation D'Allongement en Double Reduction a Sollac Basse–Indre" Cahiers D'Informatons Techniques de La Revue De Metallurgie, vol. 89, No. 12, Dec. 1, 1992, pp. 1101–1109, XP000354225.

Patent Abstracts of Japan, vol. 015, No. 333 (M–1150), Aug. 23, 1991, & JP 03 128111 A (Toshiba Corp), May 31, 1991.

Patent Abstracts of Japan, vol. 017, No. 120 (M–1379), Mar. 12, 1993 & JP 04 305305 A (Kawasaki Steel Corp), Oct. 28, 1992.

Patent Abstracts of Japan, vol. 007, No. 044 (M–195), Feb. 22, 1983 & JP 57 193213 A (Shin Nippon Seitetsu KK), Nov. 27, 1982.

*Primary Examiner*—Ed Tolan
*Attorney, Agent, or Firm*—Oblon, Spivak, McClelland, Maier & Neustadt, P.C.

[57] ABSTRACT

A method of controlling a continuous skin-pass and reduction operation for a metal strip includes the steps of passing a strip through a gap between working rollers of at least two successive rolling stands, only an upstream one of the stands providing substantial thickness reduction of the strip; determining an extension rate of the strip provided by the upstream stand; determining a tension of the strip downstream of the upstream stand; adjusting the speed of the working rollers of the upstream stand compared to the speed of the working rollers of a downstream one of said stands according to the determination of the extension rate; and adjusting the squeezing force of the upstream stand according to the downstream tension determination. A response time to the step of adjustment of the squeezing force is longer than a response time to the step of adjusting the speed of the working rollers.

2 Claims, 9 Drawing Sheets

CONTROL PROCESS FOR CONTINUOUS SKIN PASS OPERATION FOR METAL STRIP

BACKGROUND OF THE INVENTION

1. Field of the Invention

The invention concerns a control process for a continuous skin pass and reduction operation for a metal strip in a skin pass mill comprising at least two successive roll stands.

2. Description of the Related Art

By skin pass and reduction operation is meant an operation conventionally called a "skin pass" or a second reduction rolling operation (called "DR"). For this type of operation one generally uses roll mills comprising at least two successive stands, of which only one, called the reduction stand, accomplishes the essential portion of the thickness reduction of the strip. In the case of a roll mill consisting of two stands, the reduction stand is the upstream stand or first stand, and in a roll mill consisting of three stands, the reduction stand is the second stand; the one in the middle of the installation.

A roll or skin-pass stand of this type of mill comprises two working rollers rotating in opposite directions, in the gap of which a metal strip can be reduced and/or cold-rolled. Depending on the squeezing force of these rollers, the thickness of the metal strip is reduced and its length is increased. For a given metal strip, the (length) extension rate achieved depends upon the squeezing force of the stand. In the case of a "skin-pass," the extension rate is low, while in the case of a "DR" operation, it can reach approximately 60%.

In these installations, the rotation speed of the rollers of two successive stands (called "stand speed" for short) must be precisely controlled in order to maintain a strip tension between these stands that is high enough to prevent the appearance of creases yet also low enough to prevent a risk of the strip breaking. Therefore between two successive stands, the stand speed differential depends on the extension rate of the strip.

For controlling these mills, one therefore generally determines the extension rate of the strip as it passes through the mill and the tension of the strip between the stands. Depending on the values measured, one acts on either the squeezing force of each stand or the speed of the rollers of each stand. To determine the extension rate of the strip in a stand, one generally measures the speed of the exiting strip and the speed of the re-entering strip. The extension rate is deduced from the difference between these two speed measurements. This type of process is described in British patent 794 290 where the speed measurements are made using speed.

In the case of a mill comprising only two stands, the article by Yuli Shimoyama et al., entitled "Kawaski continuous annealing line at Chiba"—IRON & STEEL ENGINEER, Vol. 69, No. 11, 1992, p. 35–41, describes three control processes on page 37, left-hand column, that are illustrated in FIG. 4 of that document:

In control according to mode 1, the extension rate is controlled by the inter-stand traction.

In control according to mode 2 (the references are to FIG. 1 hereinafter), one controls lengthening by the ratio between the speed of the upstream "S-block" 1' and that of the first downstream stand 2. Control (dead strip "ATL" system) of the traction between the "S-block" 1' and the first stand 2 is according to the speed and squeezing ratio of the first stand 2.

Control according to mode 3 is identical to that of mode 2, but the extension rate measurements are replaced by thickness measurements ("THG").

Mode 2 is schematized in the diagram in FIG. 1, where 1', 2 and 3 designate respectively the "S-block," the first stand and the second stand. Elements 4A and 4B are the device for measuring the extension rate.

In the case of a roll mill comprising three stands, the article by C. SILVY-LELIGOIS entitled "Extension control in dual reduction in Sollac Basse-Indre"—REVIEW of METALLURGY, Vol. 89, NO. 12, 1992, p. 1101–1109—describes another control strategy. There control of the inter-stand traction by the speed, and control of extension is via the squeezing of stand 2 and via the traction between stands 2 and 3.

This strategy is schematized hereinafter in FIG. 2, which reproduces FIG. 3 of the article cited. In this FIGS., 1, 2 and 3 designate respectively the first, second and third stand, and 4A and 4B designate the device for measuring the extension rate.

Finally, FIG. 3 shows the state of the art in the case of a mill comprising only two stands 2 and 3. There, control of the inter-stand traction by the speed, and control of extension is by squeezing and, optionally, inter-stand traction. This type of control is also described in FR 2 584 631 (MITSUBISHI).

Thus, as illustrated in FIGS. 1 to 3, to control this type of skin-pass mill, one makes a dual adjustment:

A—adjustment of the speeds of two successive stands according to the tension value of the strip between these stands, adapted to prevent breaking of the strip or the appearance of creases.

B—adjustment of the squeezing force of the reduction stand according to the difference between the strip extension rate provided by this stand and a predetermined extension rate set-point.

The transfer function of adjustment B is complex since the law of behavior linking force and extension is not at all linear. This law of behavior is similar to the standard law of behavior linking traction and extension, as illustrated in FIG. 4. According to this law, as the extension increases from zero, the traction begins by increasing sharply, then decreases slightly in irregular fashion before increasing slightly again and stabilizing. As the actions on the squeezing force (actuating element of adjustment B) have an impact on the tension value of the strip between two stands (measurement of adjustment A), the adjustment A will interact with the adjustment B.

Therefore it is important that the response time of adjustment A be sufficiently rapid with respect to that of adjustment B so that the changes in the squeezing force do not risk causing breaks in the strip or creases between two successive stands. Adjustment B is a "dead strip" type of adjustment.

This type of control process for skin-pass mills has numerous disadvantages for adjustment of the strip extension rate (adjustment B), including, among others, a response time that is too long, for it must remain longer than that of adjustment A; insufficient precision, more particularly due to the dead strip and the complexity (non linear) of the transfer function.

SUMMARY OF THF INVENTION

It is an object of the present invention to eliminate the above disadvantages.

To this end, the invention targets a control process for a continuous skin-pass and thickness reduction operation for a metal strip B in Which the band is passed through the gap between the working rollers of at least two successive rolling stands, the upstream accomplishing the essential part of said thickness reduction, in which, in order to continuously regulate the rotation speed and the squeezing force of the rollers of the thickness reduction stand, one determines the extension rate of the strip produced by this stand, and the tension of the strip downstream of this stand. The speed of the rollers of this stand compared to the speed of the rollers of the downstream stand is adjusted according to the determined extension rate, and the squeezing force of this stand according to the determined downstream tension is adjusted. The response time for adjustment of the squeezing force is much longer than the response time for the speed adjustment.

Preferably the squeezing force of this stand is set so as to keep the measured tension within a predetermined range of values, any potential change of the squeezing force occurring only when said strip tension leaves said range. This type of adjustment is typically called "dead strip adjustment."

BRIEF DESCRIPTION OF THF DRAWINGS

The invention will be better understood by reading the description that follows, given by way of non-restrictive example, and in reference to the appended figures in which.

DETAILED DESCRIPTION OF THF PREFERRED EMBODIMENT

Figure 5:
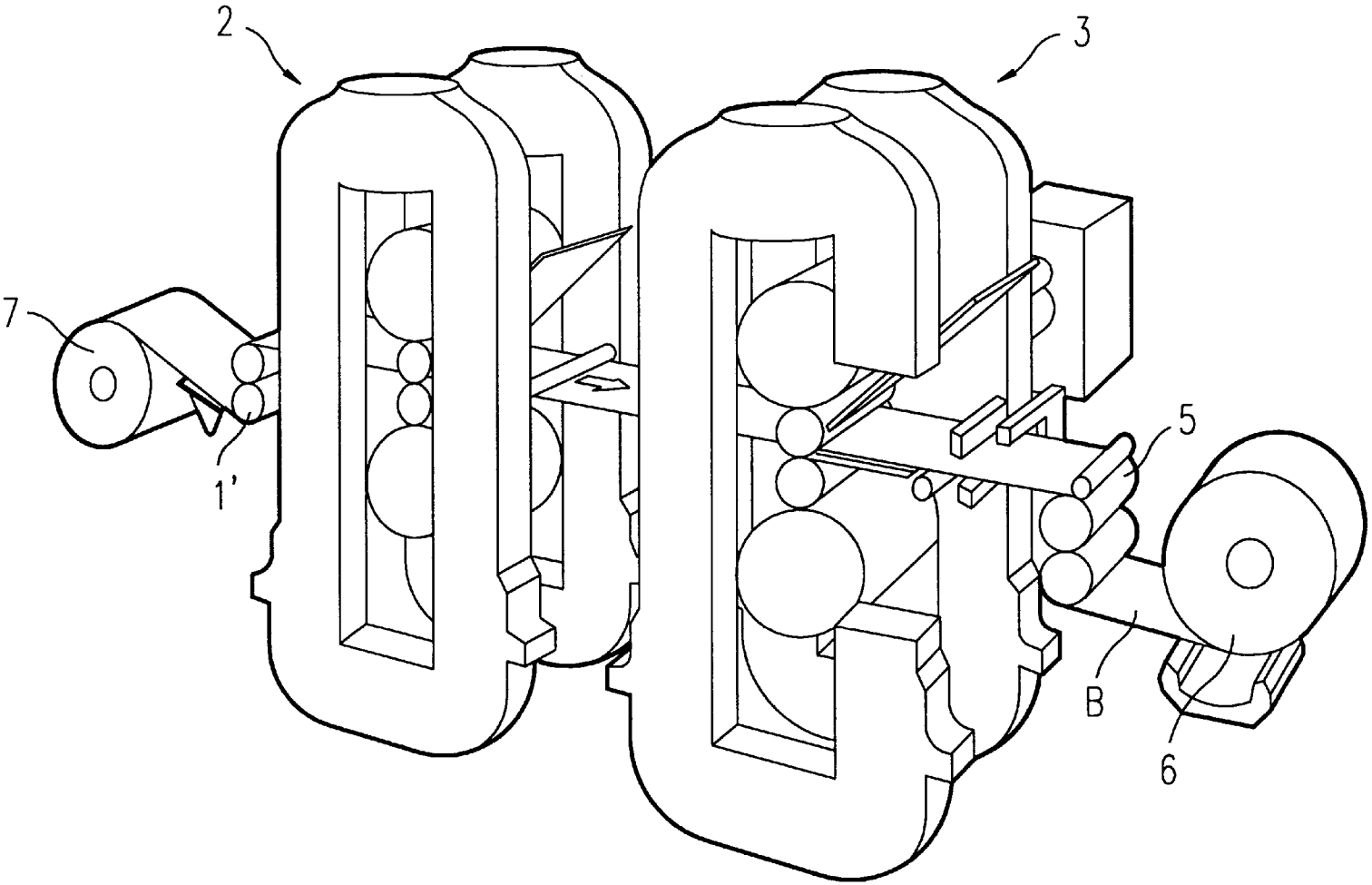
FIG. 5 is a schematic view in perspective of a reduction and/or skin-pass mill comprising two stands that can be controlled by the process in accordance with the invention.

In FIGS. 1 to 3 and 5 to 7, by convention, the strip travels from left to right (see arrow in FIG. 5). Referring to FIG. 5, the continuous skin-pass mill for metal strip comprises, in the direction of travel of the strip B, an unwinder (7), an entry S-block (1'), a first press stand (2), a second press stand (3), an exit S-block (1') and a rewinding stand (6).

The unwinder (7) and the rewinding stand (6) are standard types and will not be described in detail.

The "S-blocks" (1', 5) are each composed of two strip bearing rollers, and serve in a standard fashion to vary the tension of the strip B. One of the rollers of each block is equipped with speed indicator devices (4A, 4B) providing precision measurement of the speed of passage of the strip B through the blocks (1', 5).

Each press stand (2, 3) comprises two working rollers, each supported by a bearing cylinder. Devices that are not shown allow one to vary the squeezing force of the working rollers against each other. Other devices (not shown) make it possible to vary the rotation speed of the working rollers of each stand. Mechanisms (not shown) are also provided for measuring the tension of the strip between the stands (2 and 3).

The functioning of the skin-pass installation according to the invention will now be described. While the strip B travels through the installation, at the last stand, i.e., stand (3), no lubricant is sprayed onto the strip B in the gap of this stand, in order not to obtain any extension or a very reduced extension of the strip B at this point. The squeezing force of this stand (3) is adapted to regulate, in known manner, the surface evenness of the strip B leaving the stand. The very reduced extension can be approximately from 0.1 to 0.5% and remains sufficiently stable so as not to disturb the regulation.

While the strip B travels through the installation in accordance with the invention, one then makes the following dual adjustment:

A'—adjustment of the speeds of the successive upstream (2) and downstream (3) stands according to the difference between the strip extension rate provided by the upstream stand (2) and a predetermined extension rate set-point.

B'—adjustment of the squeezing force of the upstream stand (2) according to the difference between said tension measured between the upstream stand (2) and the downstream stand (3) and a predetermined tension set-point.

Figure 6:
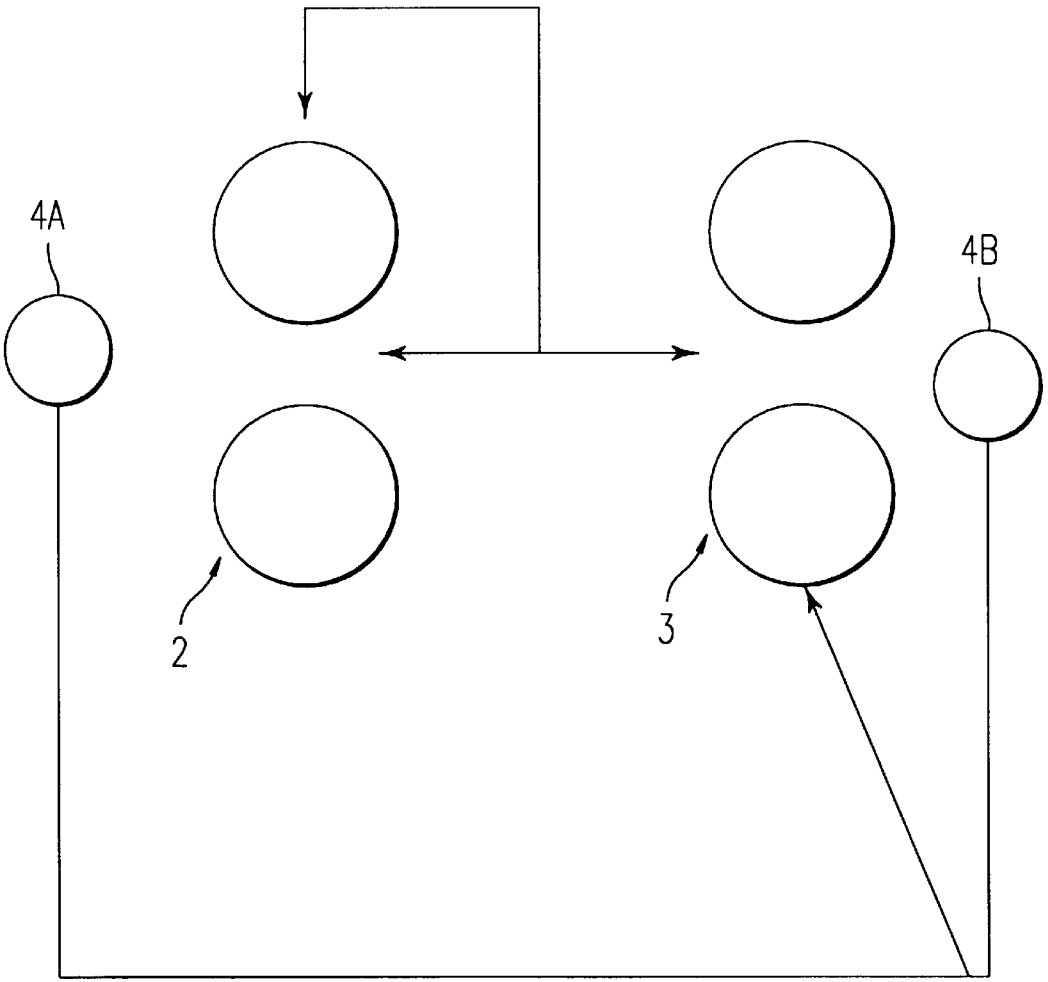
FIGS. 6 and 7 are control diagrams in accordance with the invention.

FIG. 6 shows the corresponding control diagram showing control of the inter-stand traction due to the squeezing of the upstream stand (2), and control of extension due to speed. For adjustment A', the measurement of the extension rate of the upstream stand (2) typically results from the speed indicator measurements taken at 4A, 4B near the entry (1') and exit (5) S-blocks, following deduction of the reduced extension rate of stand (3). Adjustment B' is preferably of the "dead strip" type. That is, one acts on the squeezing force only if the tension of the band leaves a predetermined range of values (the maximum corresponding, for example, to a risk of breakage, the minimum, for example, to a risk of the appearance of creases).

According to the invention, the gain of adjustment B' must be adapted so that the response time of this adjustment is much longer than the response time of adjustment A'. As a variation, adjustment B' can even be performed "manually" by the mill operator.

This new method for controlling the skin-pass mill provides advantages including very high precision of the extension rate of the strip: for extension rates corresponding to a skin-pass operation and generally falling between 0.4% and 4%, one achieves a precision of ± 0.05%; great "sturdiness" of control, because the transfer function of adjustment A' is linear since the measurements of strip speed act on a speed actuating element; and very great regularity in precision and a very short response time, which makes it possible to reduce strip shearing appreciably; as the speed actuating element is much faster than the squeezing actuating element, for adjustment A', one achieves a response time of 200 ms. These advantages make it possible to limit strip shearing during production.

In the case of a rolling and/or skin-pass mill comprising three successive stands 1, 2 and 3 and in which stand 2 is the reduction stand, the first stand (1) plays the role of the "S-block" (1') of the installation described previously. Its speed serves to control the traction in front of the second stand (2) (see FIG. 7). This first stand produces virtually no extension, like the last stand (3) of the previous example, and simply functions as a strip "pincher." The two other stands function like stands (2) and (3) of the preceding example.

Figure 1:
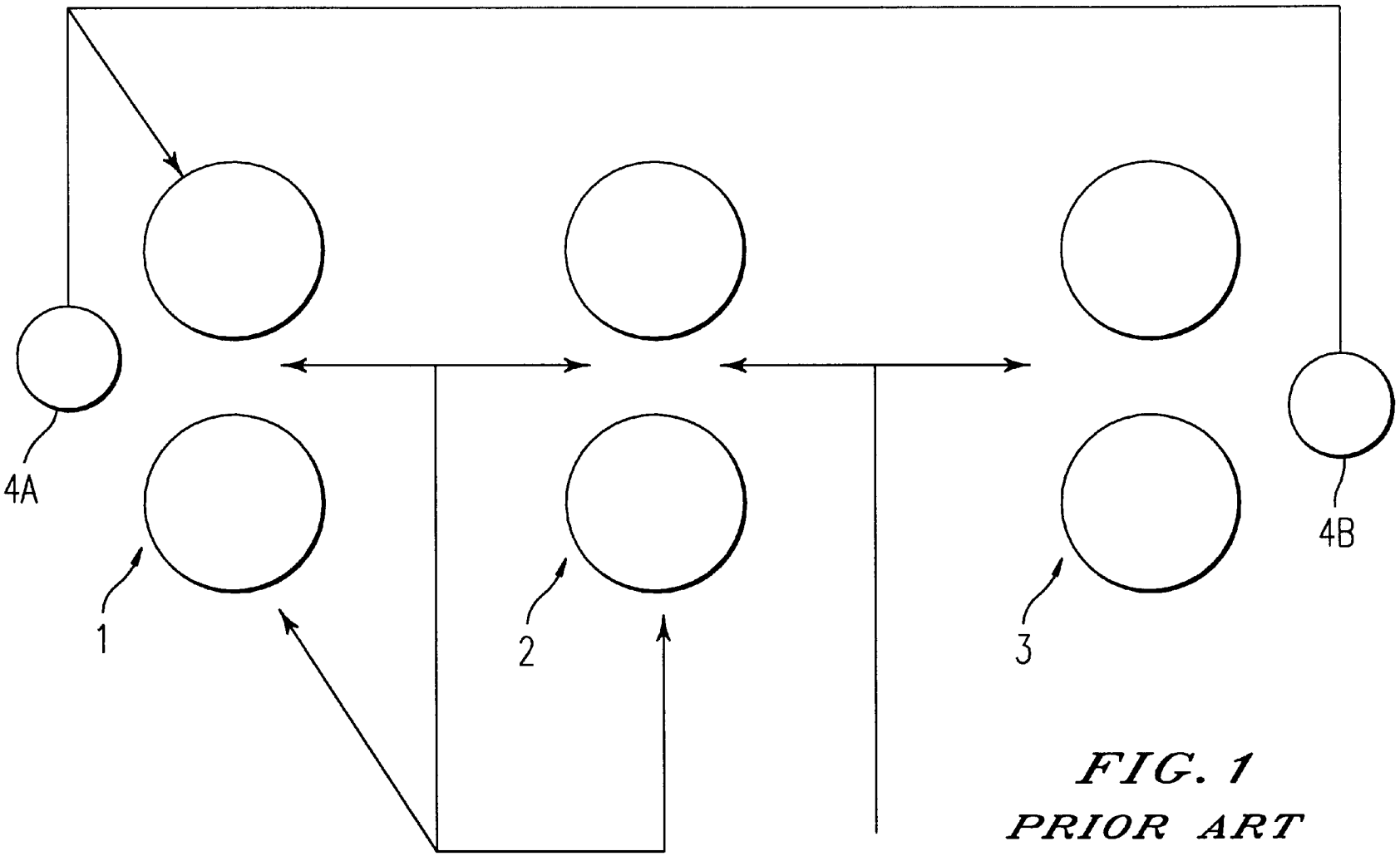
FIG. 1 PRIOR ART
FIGS. 1 to 3 show conventional control diagrams.
Figure 2:
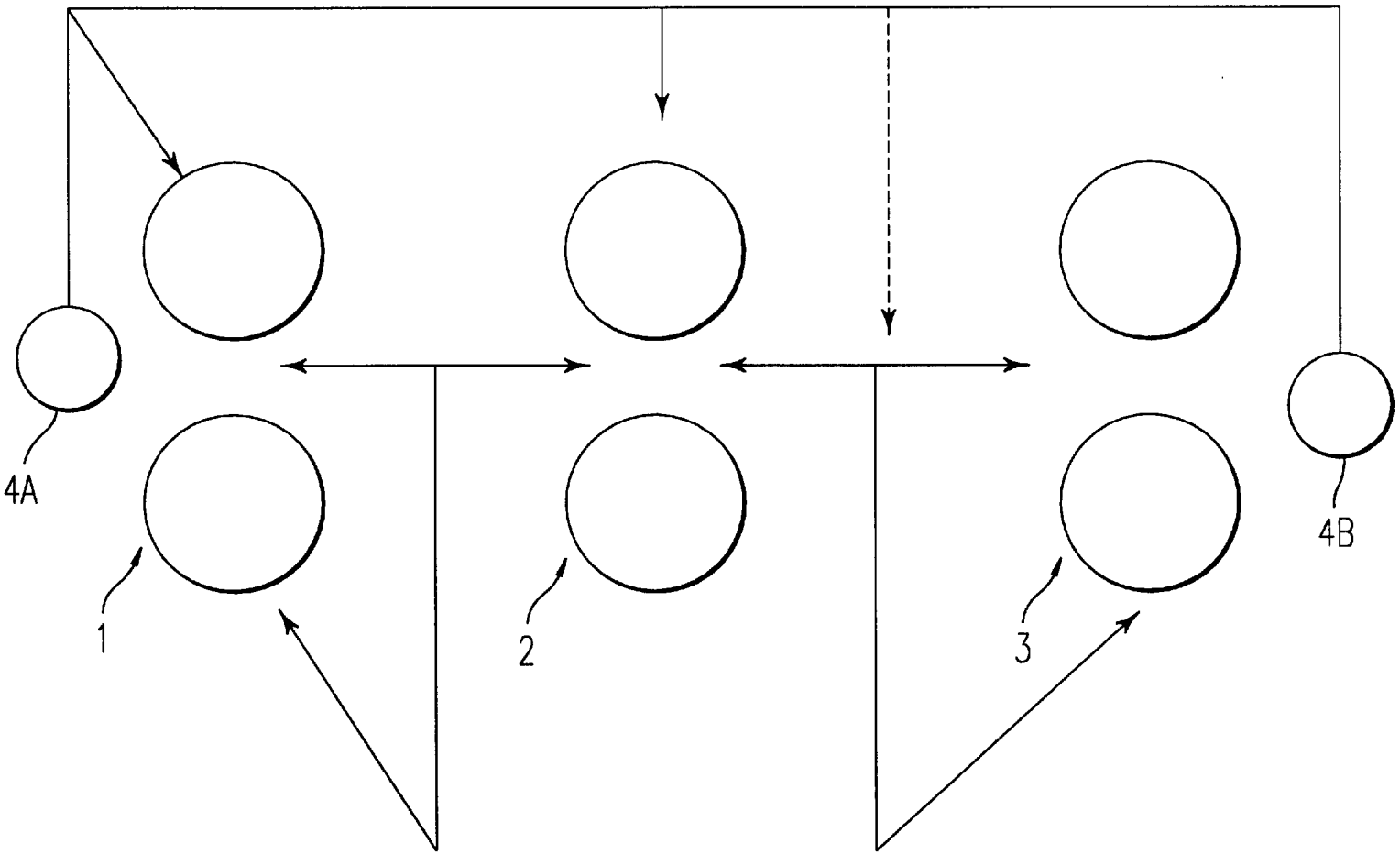
FIG. 2 PRIOR ART
Figure 3:
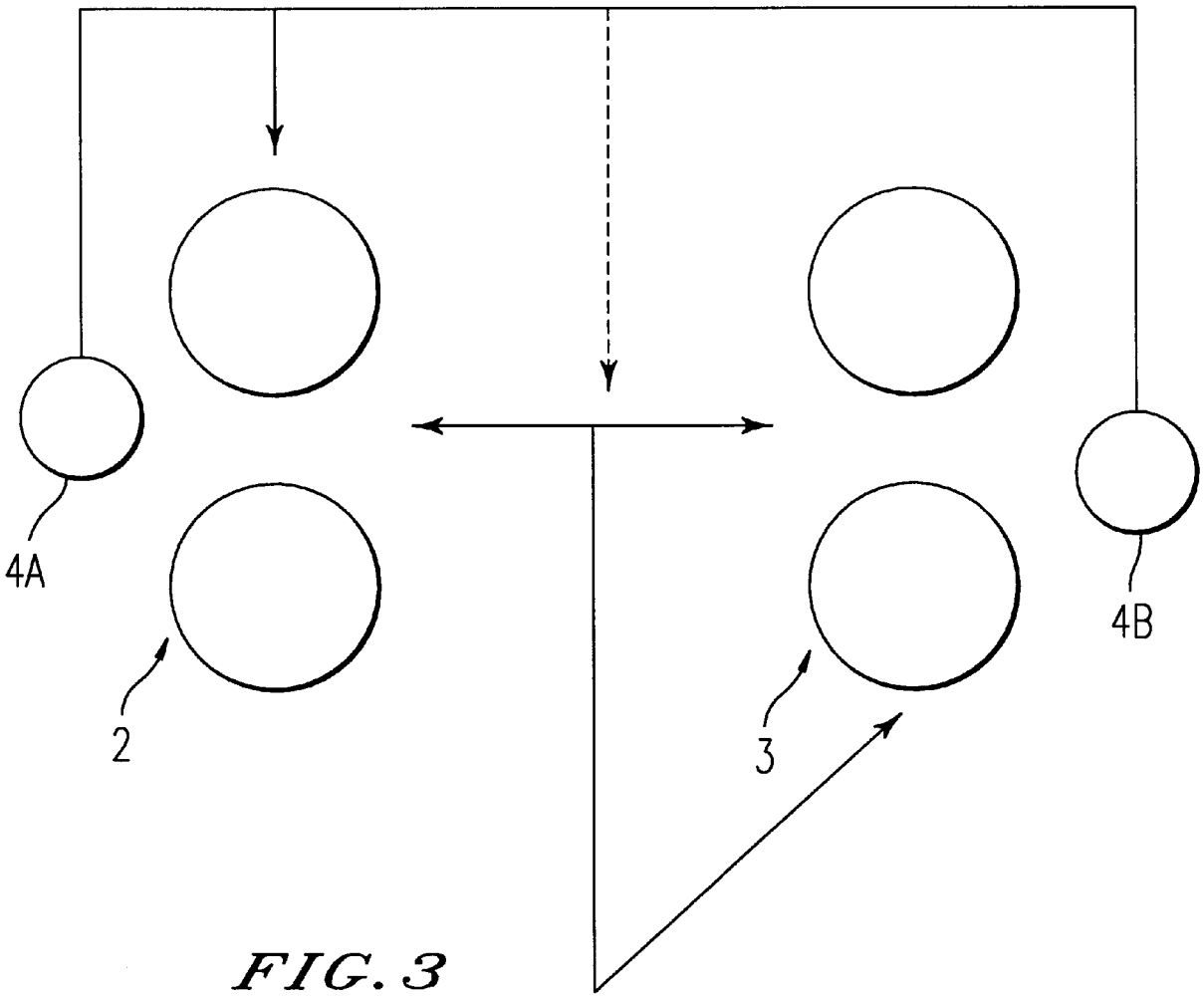
FIG. 3 PRIOR ART
Figure 4:
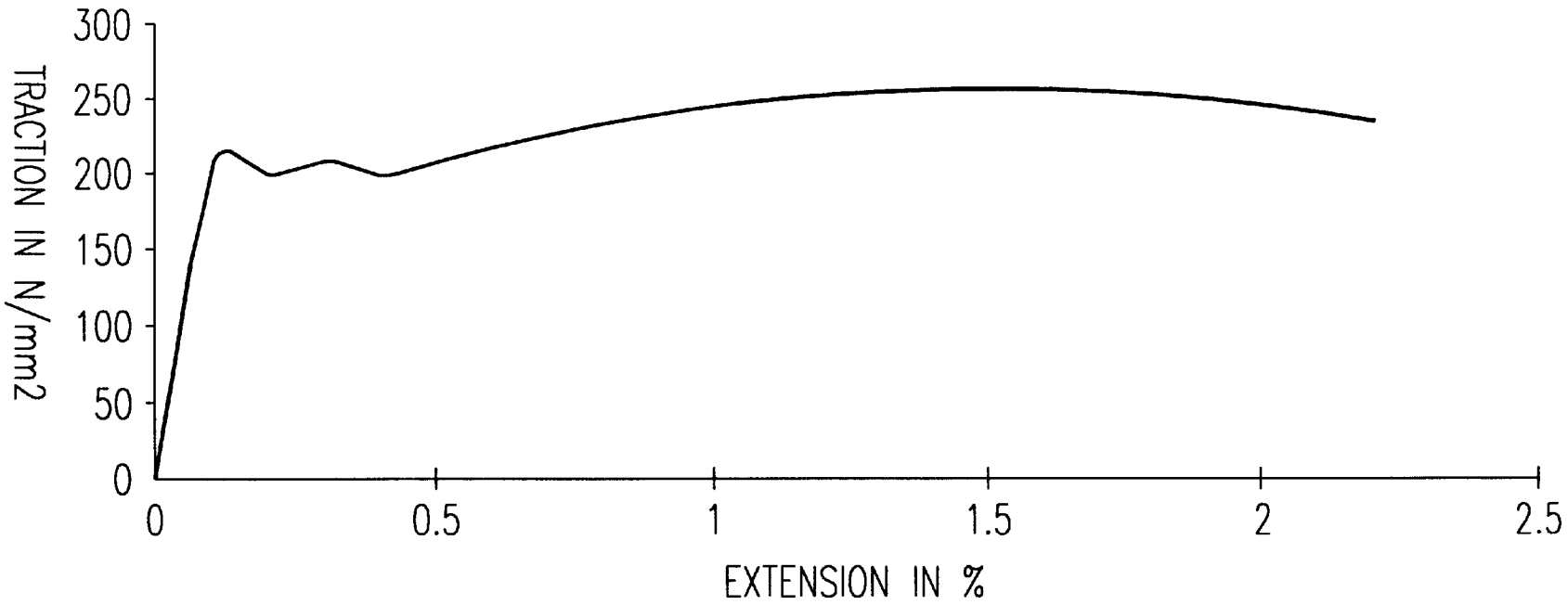
FIG. 4 shows a typical law of behavior of variation of the traction (N/mm2) of the strip according to its extension (%) in a reduction and/or skin-pass stand.
Figure 7:
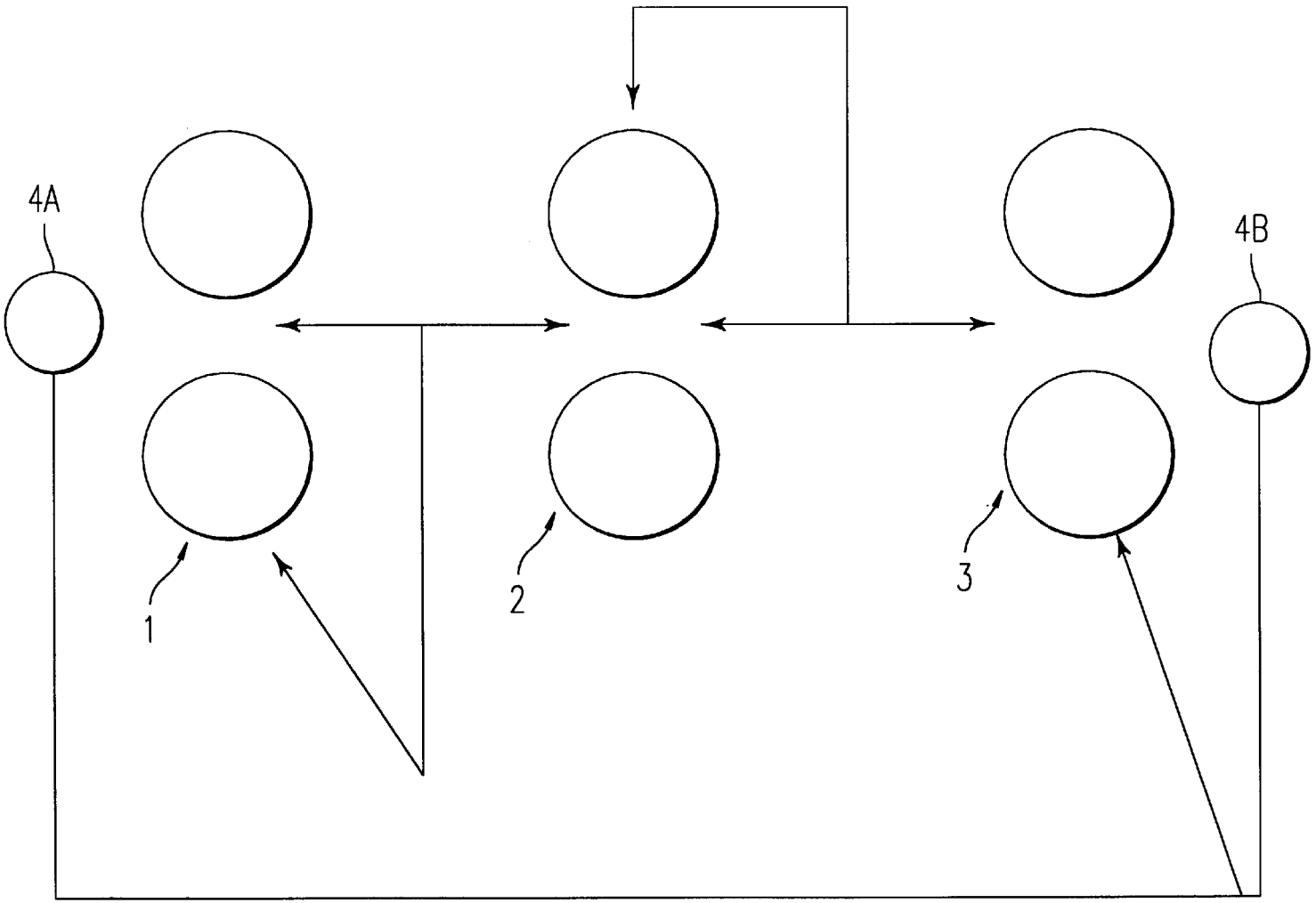

The control strategy according to this embodiment is illustrated in FIG. 7. Control of the first inter-stand traction is by the speed, as in the prior art (FIG. 2). Control of the second inter-stand traction, downstream of stand (2), is by the squeezing at the stand (2) which is the stand that applies the main thickness reduction. Control of extension is by the relative speed of stands (2) and (3).

The following example illustrates the advantages offered by the invention. The purpose of this example is to compare the control performance of the invention with that of conventional control in the case of a rolling operation for a steel strip performed after annealing (called "double reduction").

To evaluate the performance, one measures the extension rate of the strip (%) as a function of time (seconds) confronted with an intentional perturbation caused in the reduction stand, and one evaluates the fluctuations of this extension rate. The control performance is better when these fluctuations are slight or when the extension rate is stable.

Figure 8:
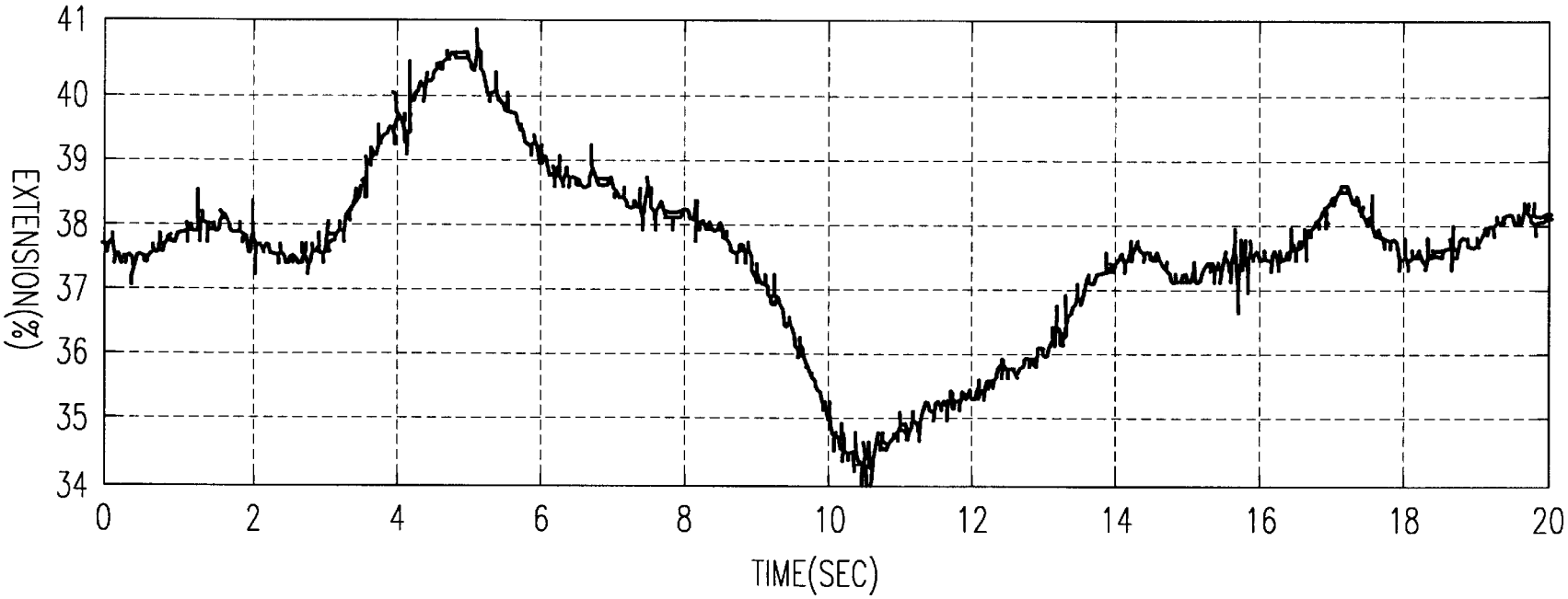
FIGS. 8 and 9 illustrate the skin-pass installation control performance, expressed in stability of the extension value (%) as a function of time (seconds), in the case of conventional control (FIG. 8) and in accordance with the invention (FIG. 9).

FIG. 8 shows these fluctuations in the conventional case where the traction is controlled by the speed and where the extension (or thickness) of the strip is controlled either directly by the squeezing of the reduction stand or indirectly by the inter-stand traction with re-centering by the squeezing of the reduction stand. One can see large fluctuations in extension: ± 3% around the average value of 37.5%.

Figure 9:
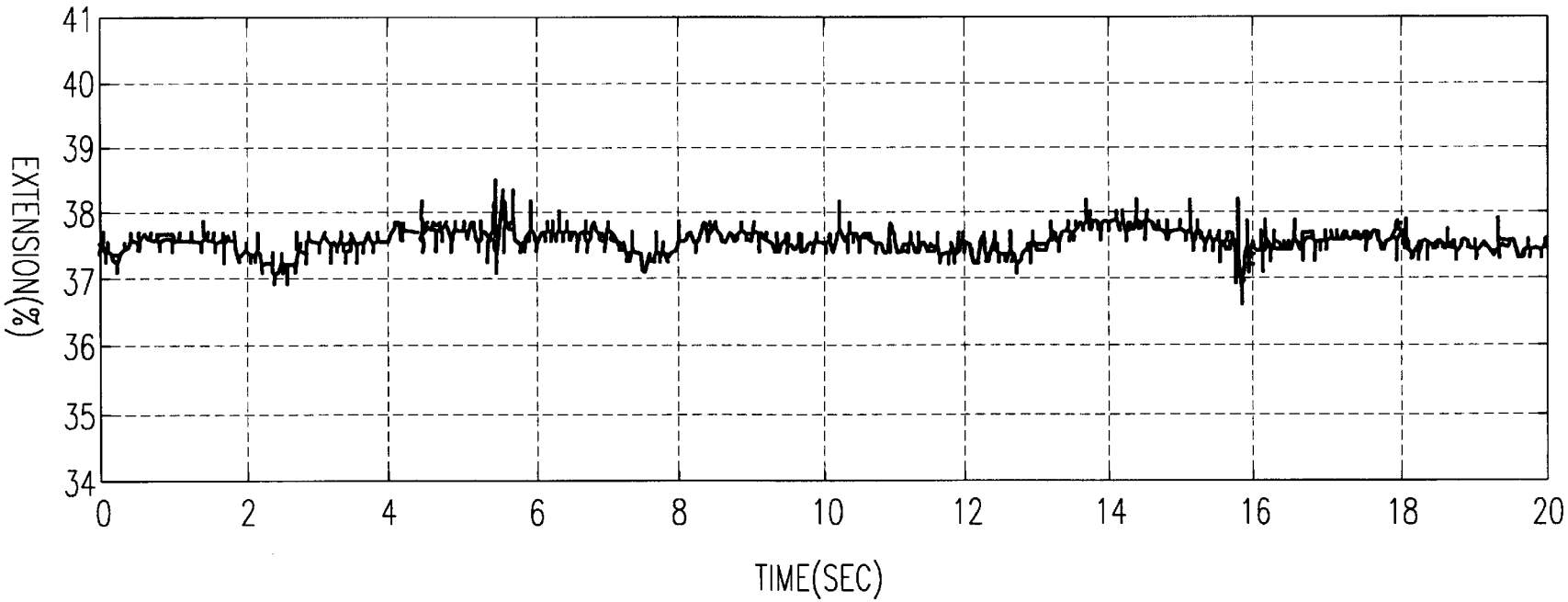

FIG. 9 shows these fluctuations, with the same perturbation where, according to the invention, the inter-stand traction is controlled by the squeezing of the reduction stand and where the extension is controlled directly by the speed of the last stand. One can see that the extension remains virtually constant, the fluctuations being reduced by a factor of at least 5 compared to the preceding case.

We claim:

1. A method of controlling a continuous skin-pass and reduction operation for a metal strip, comprising the steps of:

passing a strip through a gap between working rollers of at least two successive rolling stands, only an upstream one of said stands, as viewed in a direction of movement of the strip, providing substantial thickness reduction of the strip;

determining an extension rate of the strip provided by the upstream stand;

determining a tension of the strip downstream of said upstream stand;

adjusting the speed of the working rollers of the upstream stand compared to the speed of the working rollers of a downstream one of said stands according to the determination of the extension rate; and adjusting the squeezing force of the upstream stand according to the downstream tension determination, wherein a response time to the step of adjustment of the squeezing force is longer than a response time to the step of adjusting the speed of the working rollers.

2. The method of claim 1, wherein said step of adjusting the squeezing force of the upstream stand comprises regulating the squeezing force of the upstream stand so as to keep the determined tension within a predetermined range of values corresponding to a substantially constant squeezing force.

* * * * *